US006866213B2

(12) United States Patent
Lake et al.

(10) Patent No.: US 6,866,213 B2
(45) Date of Patent: Mar. 15, 2005

(54) ROLLED WEB PRODUCTS HAVING A WEB WOUND IN AN OSCILLATING FASHION

(75) Inventors: Andrew M. Lake, Kimberly, WI (US); Edward G. Wollangk, Oshkosh, WI (US); Gregory J. Rajala, Neenah, WI (US); Moshe Saraf, Menasha, WI (US); Daniel J. Oshefsky, Neenah, WI (US)

(73) Assignee: Kimberely-Clark, Worldwide, Inc., Neenah, WI (US)

( * ) Notice: Subject to any disclaimer, the term of this patent is extended or adjusted under 35 U.S.C. 154(b) by 209 days.

(21) Appl. No.: 10/029,125

(22) Filed: Dec. 28, 2001

(65) Prior Publication Data

US 2003/0122007 A1 Jul. 3, 2003

(51) Int. Cl.[7] ..... B65H 18/28; B65H 55/04; B65H 18/08

(52) U.S. Cl. ..... 242/160.1; 242/160.2; 242/174; 242/176; 242/178; 242/471; 242/596

(58) Field of Search ..... 242/160.1, 174, 242/176, 178, 528, 535, 547, 548, 535.4, 541.3, 364.1, 160.2, 160.4, 471, 593

(56) References Cited

U.S. PATENT DOCUMENTS

| | | | | |
|---|---|---|---|---|
| 1,178,566 A | | 4/1916 | Wright | |
| 1,333,147 A | | 3/1920 | Wright | |
| 1,677,491 A | * | 7/1928 | Rice | 242/174 |

(List continued on next page.)

FOREIGN PATENT DOCUMENTS

| | | |
|---|---|---|
| WO | 9916693 | 4/1999 |
| WO | 9959907 | 11/1999 |
| WO | 0142119 A1 | 6/2001 |

OTHER PUBLICATIONS

U.S. Appl. No. 10/027,925, filed Dec. 28, 2001, entitled "Method and Apparatus for Winding a Web", KCX–487–A (17429–A).

(List continued on next page.)

*Primary Examiner*—Eileen D. Lillis
*Assistant Examiner*—Evan Langdon
(74) *Attorney, Agent, or Firm*—Dority & Manning, P.A.

(57) ABSTRACT

An apparatus and method is disclosed for winding a web about a central axis and a rotating mandrel to form a roll. A rolled web product with an alternating winding pattern may be manufactured. A feeding mechanism provides a running web to be wound into a roll. A retainer assembly may be configured for holding the web as it is wound upon the rotating mandrel. The retainer assembly may be configured to accommodate oscillating movement of the rotating mandrel between a clockwise and a counterclockwise direction. The web may be placed upon a roll by winding in one direction and then back again in a second direction repeatedly to form a roll. Retaining means, such as paddles, may be actuated from an active position in contact with the web to a resting position removed from the roll. Paddles may serve to hold the web upon the outer surface of the roll at the time in which the rotating mandrel is changing rotational direction.

22 Claims, 10 Drawing Sheets

U.S. PATENT DOCUMENTS

| | | | | | |
|---|---|---|---|---|---|
| 2,082,489 | A | * | 6/1937 | Goldsmith | 242/471 |
| 3,719,330 | A | | 3/1973 | Antonio | |
| 3,806,054 | A | | 4/1974 | Johnson et al. | |
| 3,810,591 | A | | 5/1974 | Haven | |
| 4,034,928 | A | * | 7/1977 | McDonald et al. | 242/528 |
| 4,162,009 | A | * | 7/1979 | Schouten | 206/389 |
| 4,389,868 | A | | 6/1983 | Strout | |
| 4,525,982 | A | * | 7/1985 | Meier | 53/430 |
| 4,568,033 | A | * | 2/1986 | O'Connor | 242/471 |
| 4,597,494 | A | * | 7/1986 | Benoit | 206/390 |
| 4,603,817 | A | * | 8/1986 | O'Connor | 242/159 |
| 4,610,408 | A | | 9/1986 | Box et al. | |
| 4,645,135 | A | | 2/1987 | Morris et al. | |
| 4,651,941 | A | | 3/1987 | Muller | |
| 4,746,076 | A | | 5/1988 | Tomma et al. | |
| 4,767,075 | A | | 8/1988 | Peters et al. | |
| 4,771,519 | A | | 9/1988 | Strout | |
| 4,773,610 | A | | 9/1988 | Nordlof | |
| 5,042,789 | A | | 8/1991 | Hediger | |
| 5,289,087 | A | | 2/1994 | Summey, III | |
| 5,310,056 | A | * | 5/1994 | Ball | 206/390 |
| 5,425,512 | A | | 6/1995 | Bichot et al. | |
| 5,456,098 | A | | 10/1995 | Hartwig et al. | |
| 5,482,225 | A | | 1/1996 | Hartwig et al. | |
| 5,832,696 | A | | 11/1998 | Nagy et al. | |
| 5,921,064 | A | | 7/1999 | O'Connor | |
| 5,927,051 | A | | 7/1999 | O'Connor et al. | |
| 5,956,926 | A | | 9/1999 | O'Connor et al. | |
| 5,966,905 | A | | 10/1999 | O'Connor et al. | |
| 5,987,851 | A | | 11/1999 | O'Connor | |
| 6,009,689 | A | | 1/2000 | O'Connor | |
| 6,176,068 | B1 | | 1/2001 | O'Connor | |
| 6,702,212 | B2 | * | 3/2004 | Abba et al. | 242/160.2 |

* cited by examiner

ROLLED WEB PRODUCTS HAVING A WEB WOUND IN AN OSCILLATING FASHION

CROSS REFERENCE TO RELATED APPLICATIONS

This patent application relates to another application entitled METHOD AND APPARATUS FOR WINDING A WEB by Lake et al. which was filed Dec. 22, 2001.

BACKGROUND OF THE INVENTION

Various manufacturing operations engage in winding web material around a central core. Such winding is employed to manufacture a host of products that are made for use in modern society, including tape, plastics, cording, nonwoven materials and the like.

Natural and synthetic textiles, nonwoven materials, and conform materials may be manufactured in a first process to produce bulk materials, and then stored for later use in a second process. For example, such material may be wound upon spools or cores for temporary storage in relatively large quantities until the bulk material is needed to manufacture products. For example, many consumer and disposable absorbent products are manufactured in a first process, and then spooled on large spools while they await a subsequent manufacturing process. In manufacturing, the spools may be removed from storage and then transported to a location where they are needed, and then placed into a manufacturing line for use. Such web materials may be fed from the spool into the manufacturing operation.

One problem encountered when unwinding elongated web material from spools or rolls is undesirable twisting of the web as it uncoils when the roll is kept in a stationary position. Various methods have been attempted to avoid twisting, which can lead to problems in manufacturing. Twisting may occur when a core or spool is placed upright on a level surface, with the core oriented vertically, and such materials are pulled or fed from the core in a direction that is not in alignment with the core or spool. Some manufacturing operations in the past have relied upon driven unwind systems to assist in such operations. However, such systems consume energy and require maintenance.

Some processes have employed continuous strips of material in a technique known as "festooning" in which the strip is folded back and forth to lay a series of strip portions, with each portion being folded relative to the next about a line transverse to the strip. The technique of festooning has been used for some time and is employed in the manufacture of packaging materials including nonwovens, fabrics, and the like. The strip may be guided into a cardboard box, or may be rolled into a cylindrical pad, as examples. International Patent Application Publications WO 99/59907 and WO 99/16693 illustrate such methods.

What is needed in the industry is a new roll that is manufactured in a manner that minimizes the opportunity for undesirable twisting during deployment of a web from the roll. A method of winding such materials in a manner that will provide reliable unspooling of web materials is desirable. Furthermore, a method or assembly that provides an opportunity to make and deploy multiple spools or rolls in succession without stopping to reload rolls would be helpful. Furthermore, a system that enables utilization of rolls without using a conventional driven unwind system would be quite useful.

SUMMARY OF THE INVENTION

The invention may include a rolled web having an outer surface. The web may or may not have a core, depending upon the configuration employed. The web may be wrapped around a core, the web having a first end and a second end, the first end of the web being positioned adjacent the outer surface of the core, and the second end of the web being positioned on the outer circumferential surface of the roll. The web is positioned upon the outer surface of the core in a manner whereby the web is positioned in a first direction, and also in a second and opposite direction, in alternating sequence, from the first end of the web to the second end of the web.

The web may be manufactured using a method of winding a material around a central core or airshaft, using an apparatus that is capable of oscillation. An apparatus is provided for winding a web around a central axis to form a roll. The apparatus may include a rotating mandrel oriented along the central axis, and a feeding mechanism including at least one roller for holding in a feed position a running web to be wound upon the rotating mandrel.

The invention may provide a method for winding a web to form a roll. The method may include steps such as providing a mandrel along an axis, and then feeding a web through a feed assembly for winding the web upon a rotating mandrel. Furthermore, a retainer assembly may be provided in operable connection to the rotating mandrel. The retainer assembly (or retainer means) may serve to preserve the web in position during rotation of the mandrel and roll.

BRIEF DESCRIPTION OF THE DRAWINGS

A full and enabling disclosure of this invention, including the best mode shown to one of ordinary skill in the art, is set forth in this specification. The following Figures illustrate the invention.

DETAILED DESCRIPTION OF THE INVENTION

Figure 1:
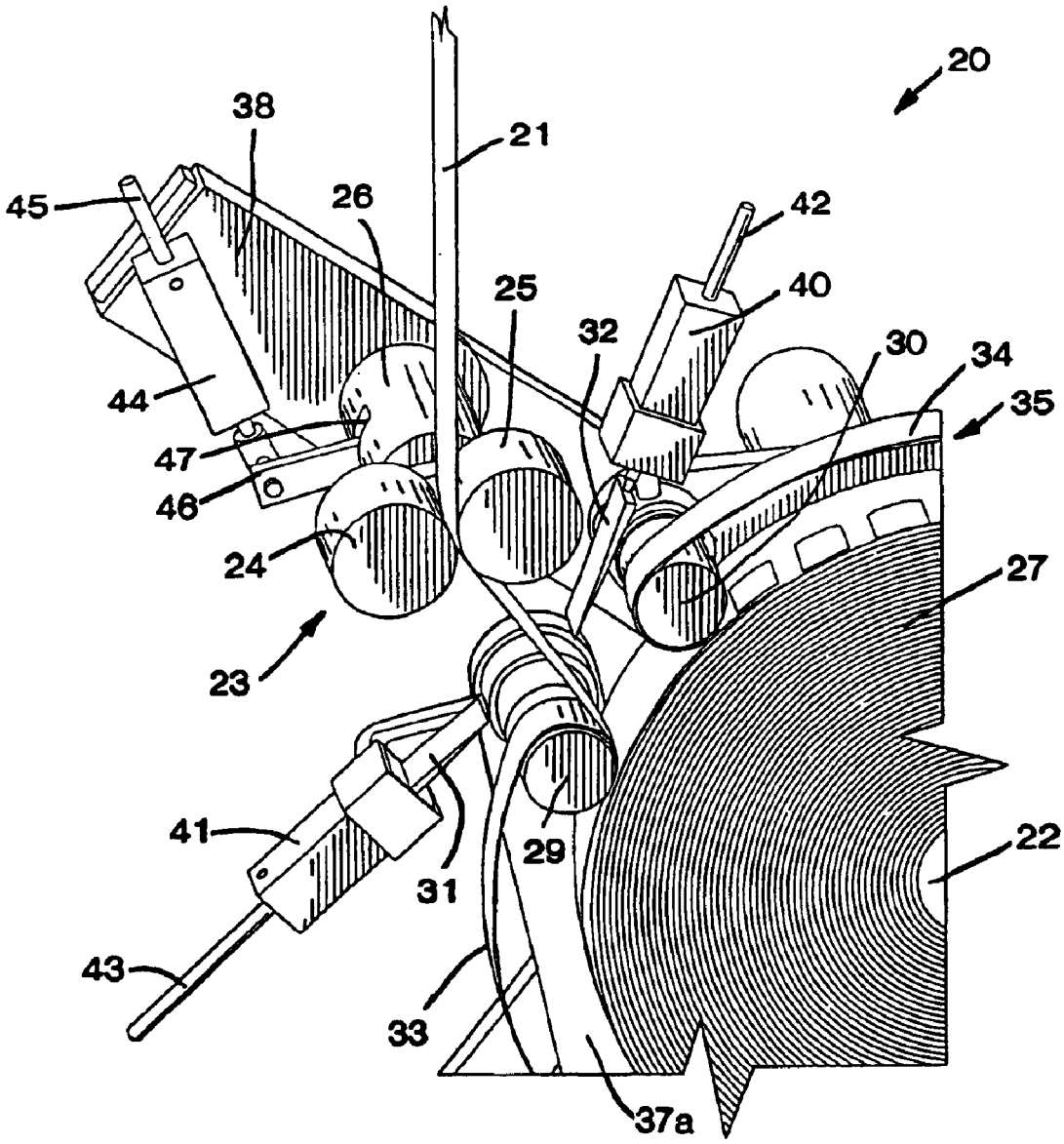
FIG. 1 is a front view of the winding apparatus in the counter clockwise mode or position.

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment.

The term "web material" or "web" as used herein refers to a sheet-like material or to a composite or laminate comprising two or more sheet-like materials. For example, such materials may include a fibrous web, a non-fibrous web, a nonwoven web, a film, a plastic film, a non-plastic film, a foam, tape, cording, textiles, rope, and tubing. Such webs or web materials may be supplied to the manufacturing process along the longitudinal dimension. Accordingly, the material may be rendered virtually infinite in the longitudinal dimension by splicing together a plurality of stretches of web material, or a plurality of rolls.

The apparatus and method of the invention may include the winding of a web or other material around a central core wherein the material is wound in an oscillating fashion. However, a core is not always required, as further discussed herein.

The web or web material may be wound in any amount, such as from about 1 to about 3 revolutions in one direction, and then the winding direction is reversed for several more revolutions, and repeated to wind a running web into a roll. In practice, the overlapped tail of the web in each revolution may be secured to the overlapped tail of the web in a previous revolution to hold the web and prevent it from unraveling during the winding process. The winding process may be repeated until the desired roll diameter is obtained. The application of the method and apparatus of the invention makes it possible to minimize the amount of twist generated in the final product or roll when the roll is unwound from a stationary position in manufacturing operations, as further described herein with reference to FIGS. 5–10.

The winding of the web may occur upon a core, or alternatively upon a collapsible airshaft. The amount of overlap employed between directional changes may be subject to web material response and footprint, and the distance required to enter the material in the converting process without an undesirable twist.

In one particular embodiment of the invention, the web is wound approximately 370–720 degrees in a clockwise direction, and then wound again 370–720 degrees in a counter clockwise direction, and repeated. The amount of overlap may be varied, and will depend upon the material to be wound, and the ultimate use for the roll. Furthermore, the overlap as described may be moved about the radius of the roll, during winding, by changing the location of the overlap as the roll is built. In practice, changing the location of the overlap sometimes prevents a double material thickness at the overlap, thereby avoiding a roll that is undesirably out of round.

Turning now to FIG. 1, a winding apparatus 20 is shown which feeds a running web 21 upon a mandrel 22 that is located along a central axis. A cleavage roll assembly 23 directs the application of the web 21 upon the roll 27. The web 21 is passed to the first cleavage roll 24 and a second cleavage roll 25. A support structure 26 is capable of controlling the position of first cleavage roll 24 and second cleavage roll 25. The cleavage roll assembly 23 therefore may include a first cleavage roll 24, a second cleavage roll 25, and a support structure 26.

A stationary retainer assembly 35 is mounted around the central axis of the mandrel 22, and is configured for accommodating oscillating movement of the roll 27 between a clockwise and counter clockwise direction. In FIG. 1, the web 21 is passed underneath the first idler roll 29 to the roll 27. A counter clockwise direction assist paddle 32 is shown in FIG. 1 in the active position in which the counter clockwise directional assist paddle 32 is extended to enable it to contact and retain the web 21 upon the outer surface of the roll 27. It should be recognized that the directional assist paddles 31–32 may be provided in any mechanical configuration, and therefore they may be flat, oblong, spherical, or multi-lobed. In some applications, only one such paddle may be required. The Figures represent one configuration having relatively flat directional assist paddles 31–32, but there are numerous shapes that could be employed in the practice of the invention.

A second idler roll 30 is also seen in FIG. 1. The second idler roll 30 controls the position of the second circumferential support stay 34. The first idler roll 29 controls the position of the first circumferential support stay 33. The first circumferential support stay 33 and the second circumferential support stay 34 work in tandem on each side of the roll 27 to retain the web 21 upon the roll as the roll 27 is building in size. The clockwise direction assist paddle 31 is shown in FIG. 1 in the retracted position.

The cleavage roll assembly 23 is typically capable of switching between two or more different modes. In the dual mode, a first position of the cleavage roll assembly 23 as shown in FIG. 1 may provide an air cylinder 44 which has been activated along rod 45 to push the bar 46 into notch 47 of the support structure 26. This activation enables the web 21 to pass in the appropriate direction between the first cleavage roll 24 and the second cleavage roll 25, as shown in FIG. 1. Support frame 38 holds the support structure 26 in position.

The clockwise direction assist paddle 31 is activated along rod 43 by air cylinder 41. The counter clockwise direction assist paddle 32 is activated along rod 42 by air cylinder 40.

In the process of winding a roll 27, the rotation of the mandrel 22 in a counter clockwise direction is halted. The clockwise directional assist paddle 31 extends to contact web 21 and introduces the web 21 into a nip area which is created by second idler roll 30 and roll 27. The mandrel 22 then begins to rotate clockwise, which may continue until the web 21 begins feeding between the roll 27 and second circumferential support stay 34, upon which the clockwise directional assist paddle is retracted.

Figure 2:
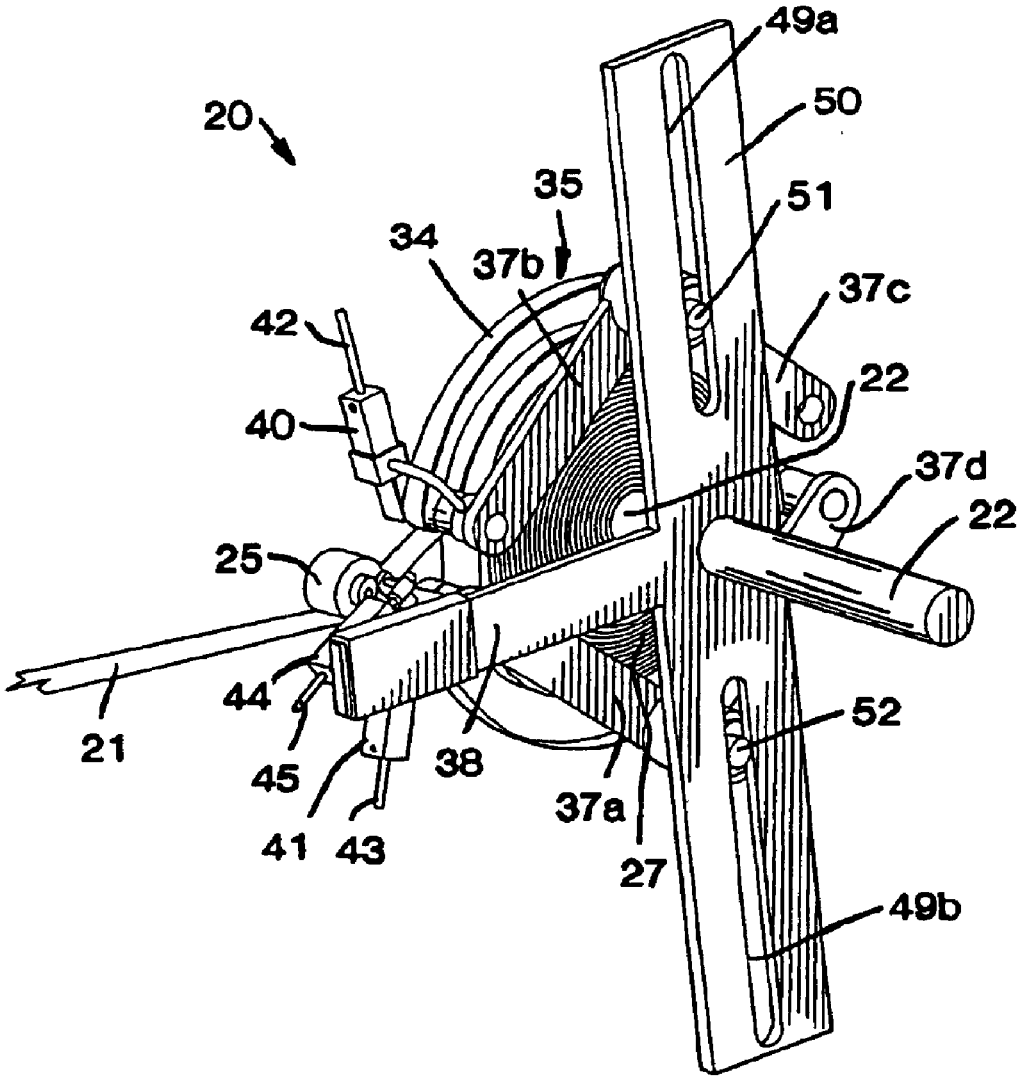
FIG. 2 shows a rear view of the winding apparatus, also in the counter clockwise position.

The retainer assembly 35 receives support from control arms 37*a–d,* as shown in FIG. 2. FIG. 2 shows a rear view of the winding apparatus 20. In FIG. 2, the mandrel has been rotated so that the web 21 is proceeding into the roll 27 from a direction that is generally parallel to the support frame 38. The support frame 38 holds in position the cleavage roll assembly 23 and the directional assist paddles 31–32.

In FIG. 2, a control arm guide member 50 including channels 49*a–b* is shown. Bolt 51 and bolt 52 are connected, respectively, to control arms 37*b–c* and control arms 37*a* and 37*d* as shown in FIG. 2. The movement of bolt 51 upwards and bolt 52 downwards allows the size of the roll 27 to expand. In that way, the control arms 37*a–d* articulate with each other to facilitate a change in size of the roll 27 as the winding process proceeds.

Figure 3:
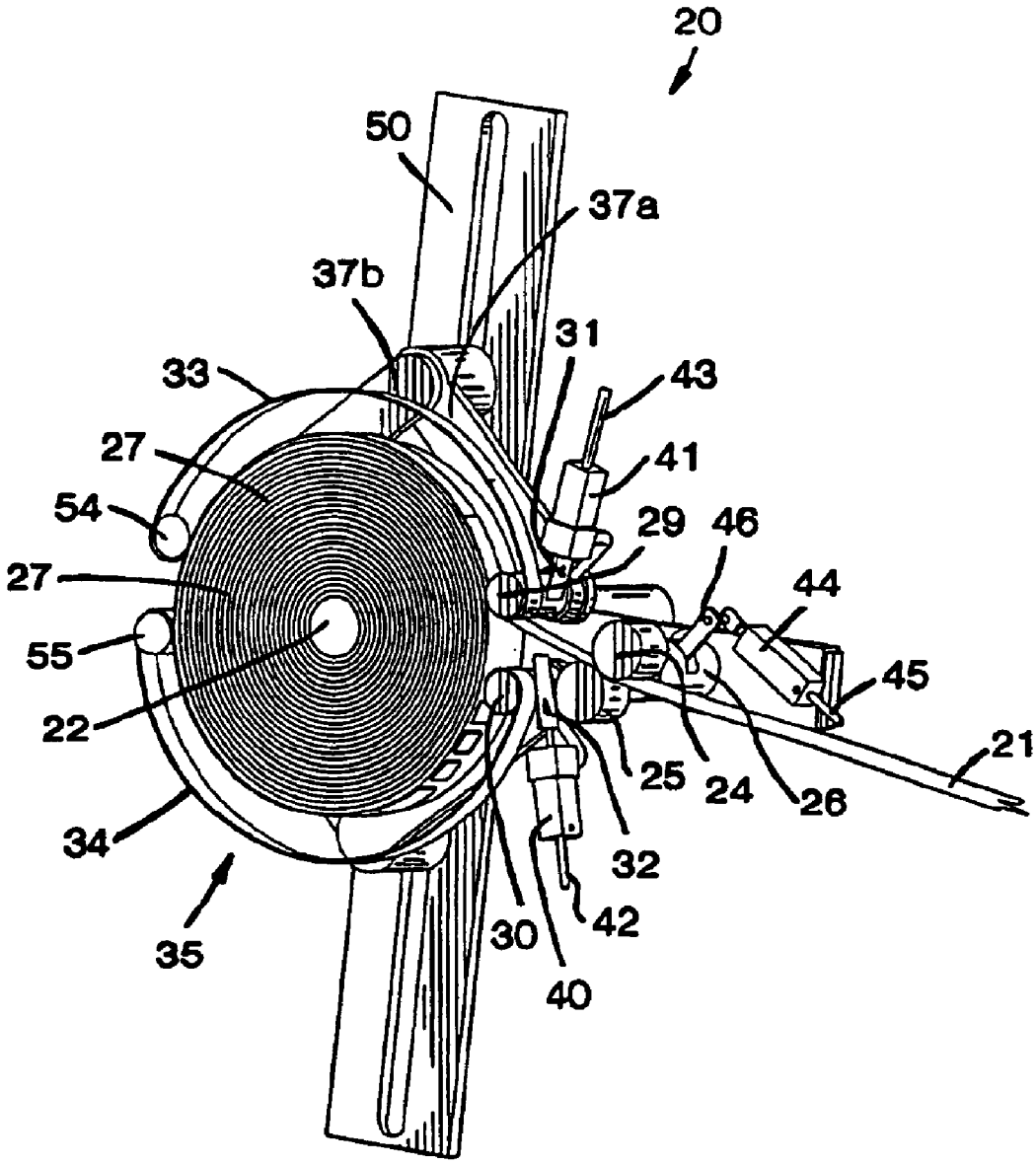
FIG. 3 depicts a second front view of the winding apparatus in the counter clockwise position, in which the mandrel has advanced or rotated towards the left in the Figure.

FIG. 3 shows a front view of the winding apparatus 20 that was seen in FIG. 2. In FIG. 3, the counter clockwise directional assist paddle 32 has been activated by the air cylinder 40 along rod 42 to an active position. Also, in FIG.

3, the clockwise direction assist paddle 31 has been retracted by movement of air cylinder 41 along rod 43 away from the roll 27. A roller 54 is shown in position to retain the first circumferential support stay 33 upon the upper surface of the roll 27. A roller 55 is shown in position to retain the second circumferential support stay 34 upon the lower path of the roll 27, as shown in FIG. 3.

Figure 4:
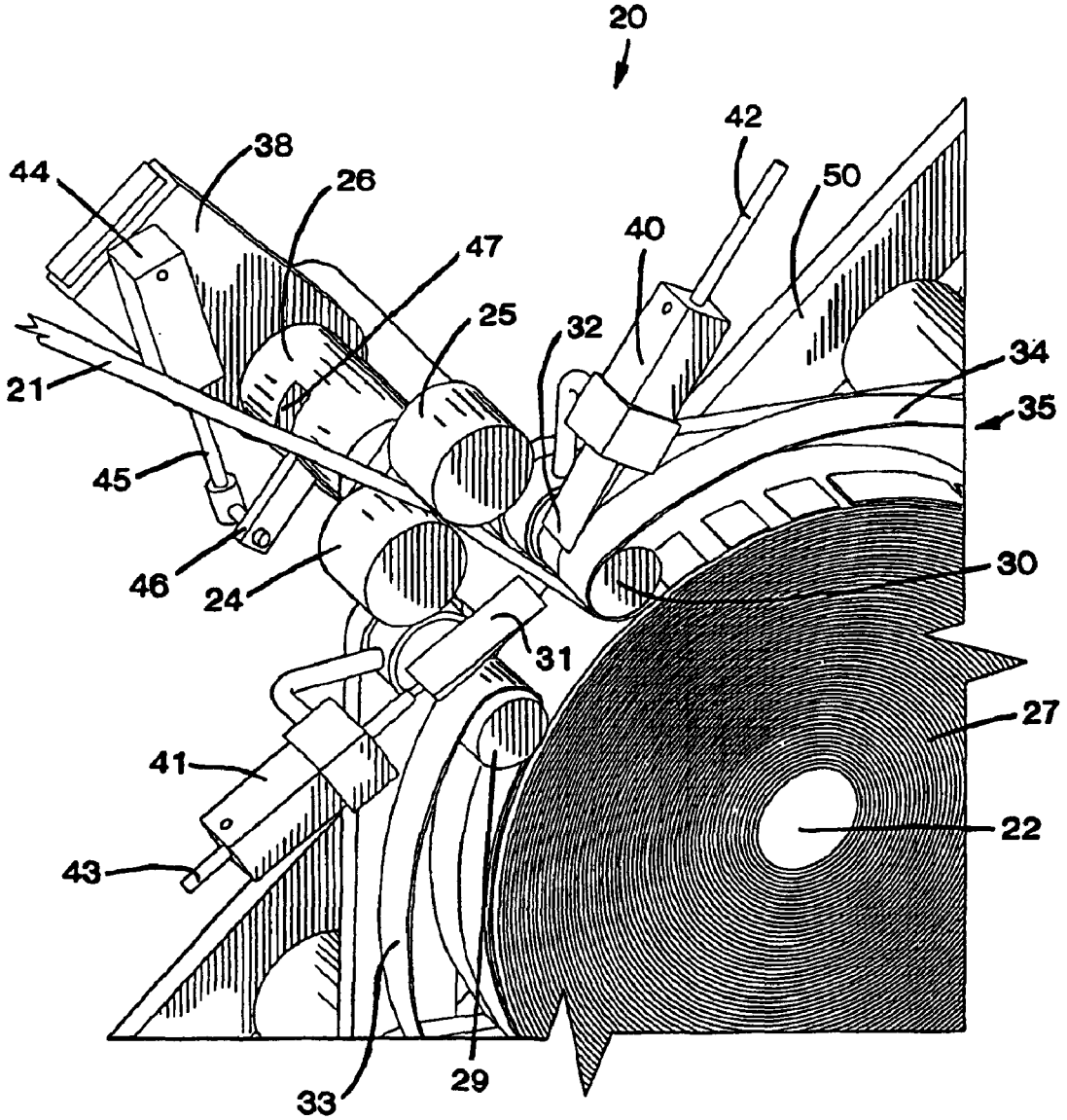
FIG. 4 is a view of the assembly in the clockwise position or mode.

As the winding assembly 20 shifts from a counter clockwise mode into a clockwise mode, several adjustments are made. As shown in FIG. 4, the winding apparatus 20 now has assumed a clockwise mode in which the counter clockwise directional assist paddle 32 has been retracted, and the clockwise directional assist paddle 31 has been extended. Furthermore, as seen in FIG. 4, web 21 now feeds from a different direction, through the first cleavage roll 24 and the second cleavage roll 25. Adjustment of the first cleavage roll 24 and second cleavage roll 25 has occurred by the actuation of air cylinder 44, which extends rod 45 to move bar 46 into notch 47, resulting in movement of the first cleavage roll 24 and second cleavage roll 25 to the position shown in FIG. 4. In that position, the web 21 now is prepared to wind upon the rotating mandrel 22 in the clockwise direction, with the clockwise direction assist paddle 31 extended to contact the surface of the roll 27. This contact holds the web 21 in position during a change in oscillation of the winding apparatus 20.

The invention is not limited to the use of such paddles to retain the roll 27 at each end of the oscillation. For example, other methods could be used to secure overlapping layers of the web 21 during winding of the roll 27. These methods include, but are not limited to, the use of adhesives, thermal bonding, ultrasonic techniques, or mechanical bonding methods. For example, an adhesive could be sprayed upon the web 21 at each end of the oscillation cycle, at about the point at which the web 21 reverses direction.

In the practice of the invention, the opportunity exists to lay several oscillated rolls (such as roll 27) on top of each other, in succession. That is, it is possible to attach the inner tail of an expiring roll to the outer tail of a new roll to provide a stack of rolls which are interconnected. Such an arrangement would permit the rolls, when they are later used, to unwind in succession. That is, multiple rolls could be wound, and connected by web 21, thereby avoiding or minimizing the need for a dynamic splice. In general, a dynamic splice refers to a splice that must be made when a roll must be replaced in the course of a manufacturing operation. Thus, a stack of rolls, or a pancake wound oscillated roll stack could be constructed, which may obviate the need to use a dynamic splice.

Figure 5:
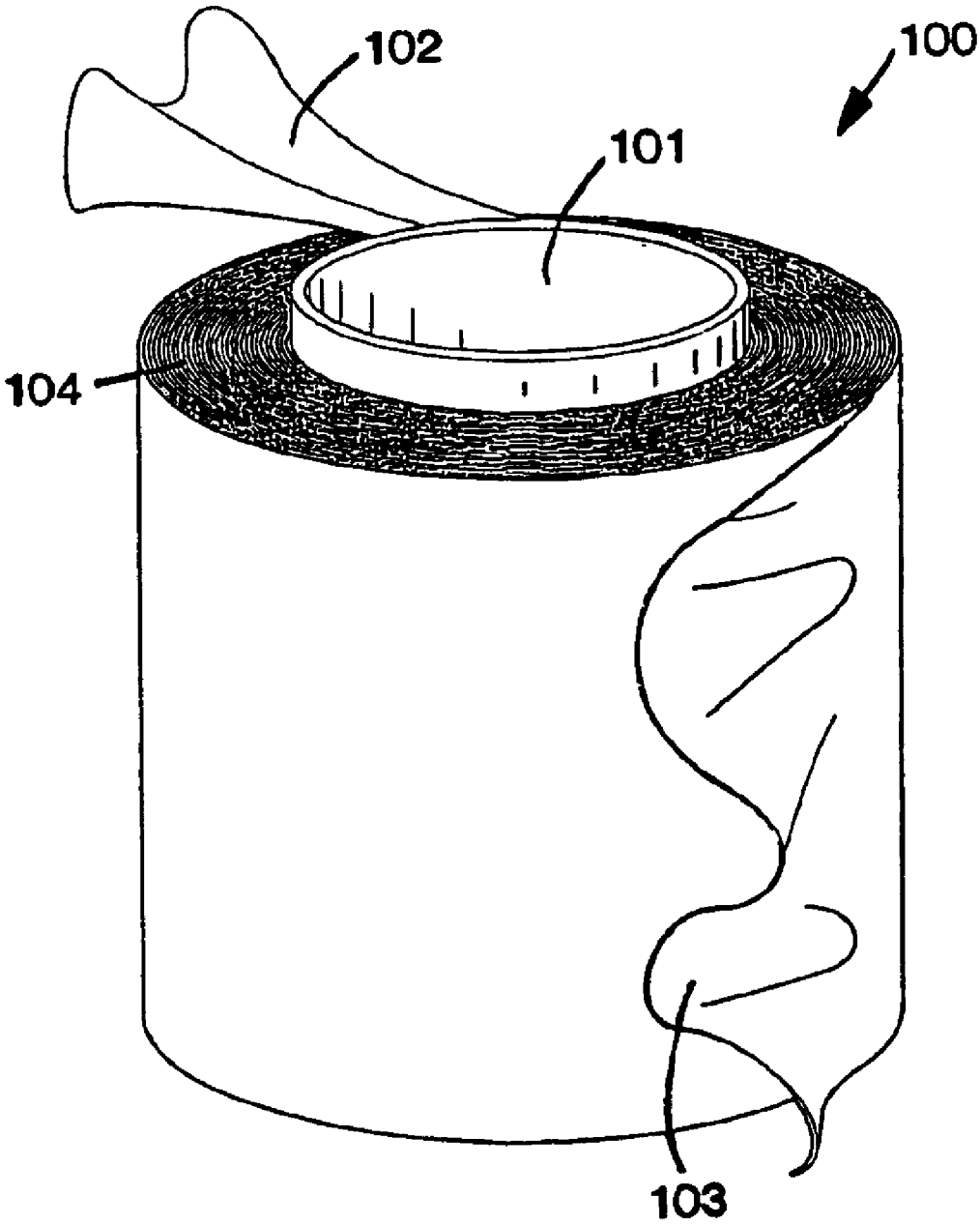
FIG. 5 shows a rolled web product manufactured using the winding apparatus shown in FIGS. 1–4.

FIG. 5 shows a sheet-like rolled web product 100 produced using the apparatus of the invention. A core 101 is used in this particular example, and a first end 102 of the web is adjacent the core 101, while a second end 103 is shown on the outer circumferential surface of the web 104.

Figure 6:
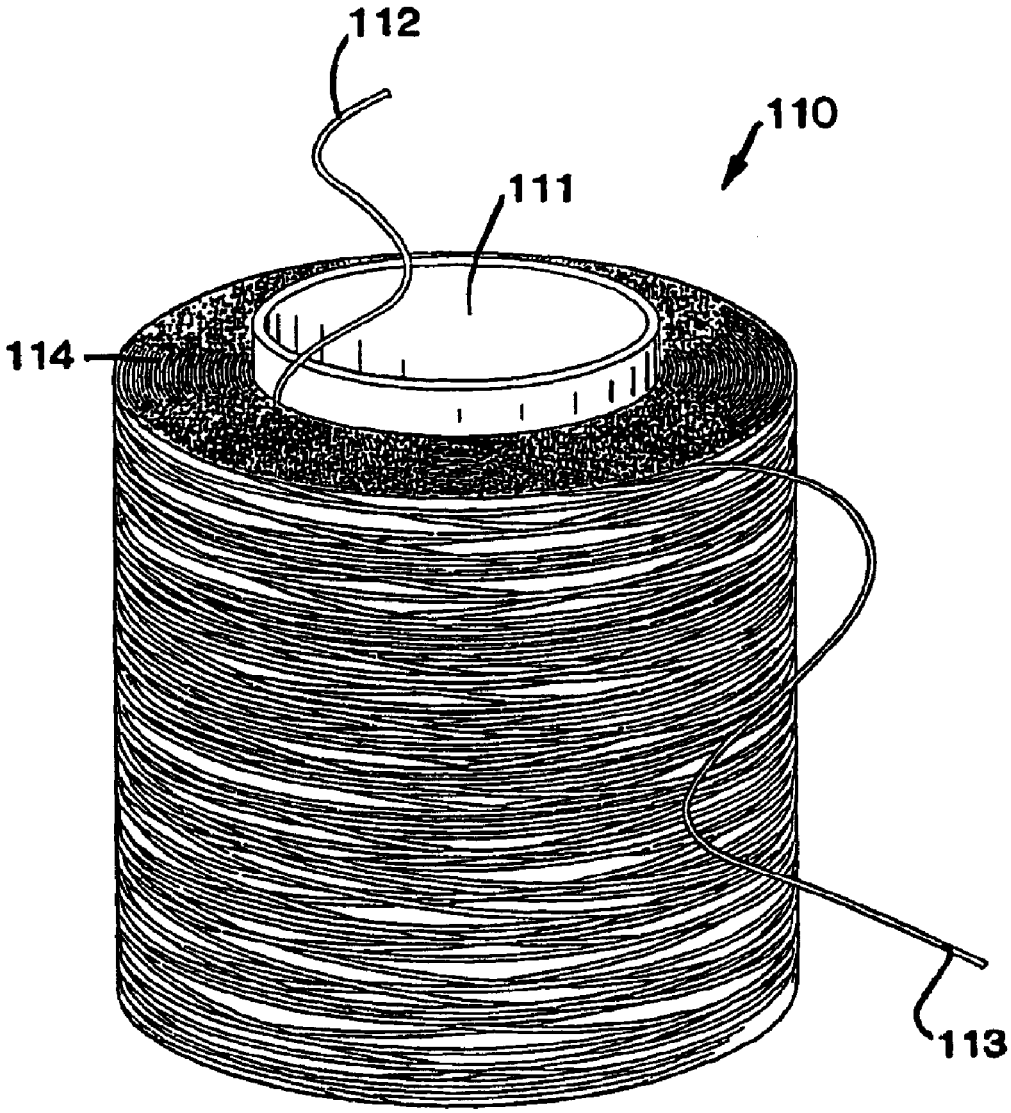
FIG. 6 shows a second embodiment of a rolled web product.

FIG. 6 shows a rope or cordage type of rolled web product 110 produced using the apparatus of the invention. A core 111 is provided in this particular example, and a first end 112 of the web is adjacent the core 111, while a second end 113 is shown on the outer circumferential surface of the web 114.

Figure 7:
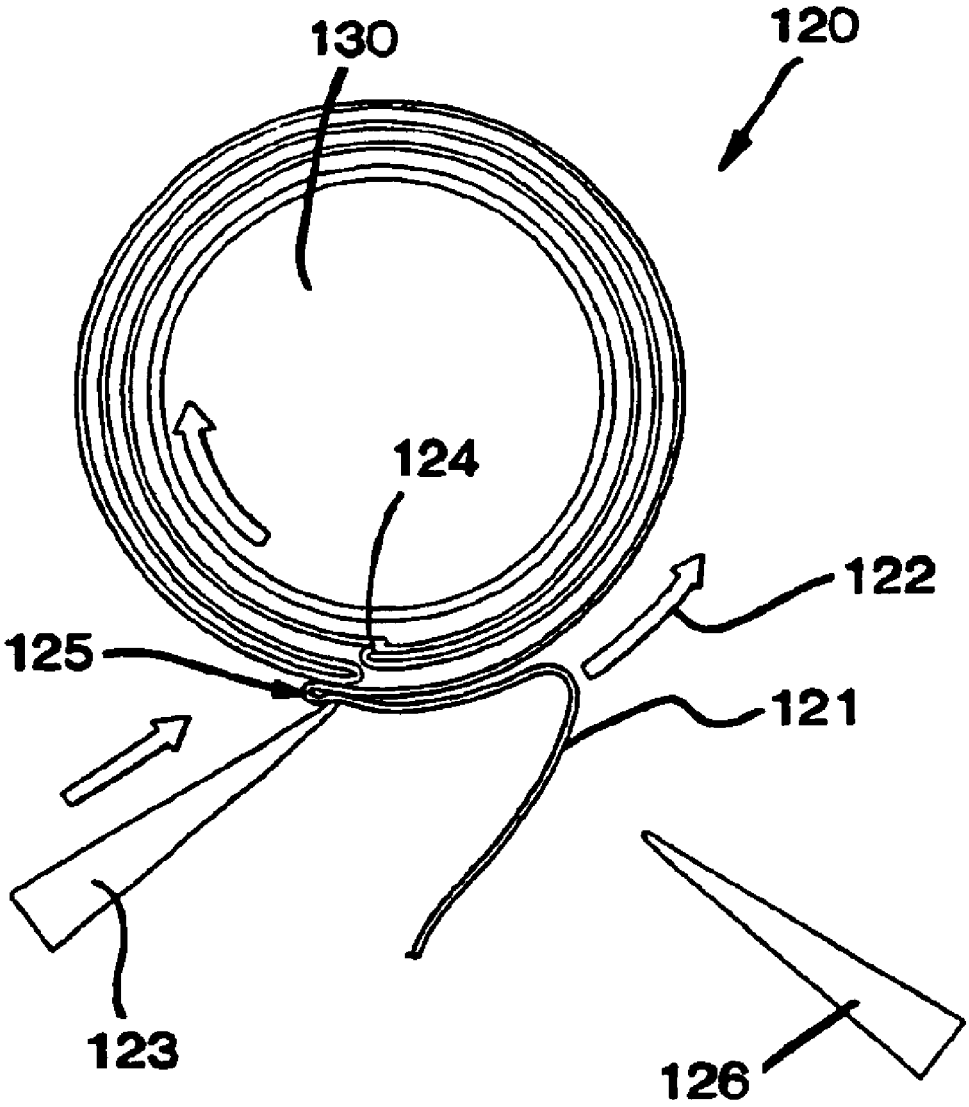
FIG. 7 is a schematic cross sectional view of a coreless rolled web product, showing how web is overlapped and is wound in both a first and second direction, in alternating sequence.

In FIG. 7, one can see the method of forming overlap using the apparatus of the invention. This particular example shows a coreless rolled web product 120. The web is positioned upon the outer surface of the center air space 130 in a manner whereby the web 121 is positioned in a first direction, and also in a second and opposite direction, in alternating sequence, from the first end of the web to the second end of the web.

The web 121 is wrapped upon the core in a pattern resulting from oscillating revolutions about the core, in which a first tail 124 (or first overlap) is formed upon the web 121 at a point corresponding to the directional change. A second overlap or second tail 125 is formed in the next revolution, and third overlap or third tail 127 in the next, and fourth overlap or fourth tail 129 in the next (see FIGS. 7–9 as well). Each successive tail is secured in an overlapping manner to the tail of the web 121 from a previous revolution.

Figure 8:
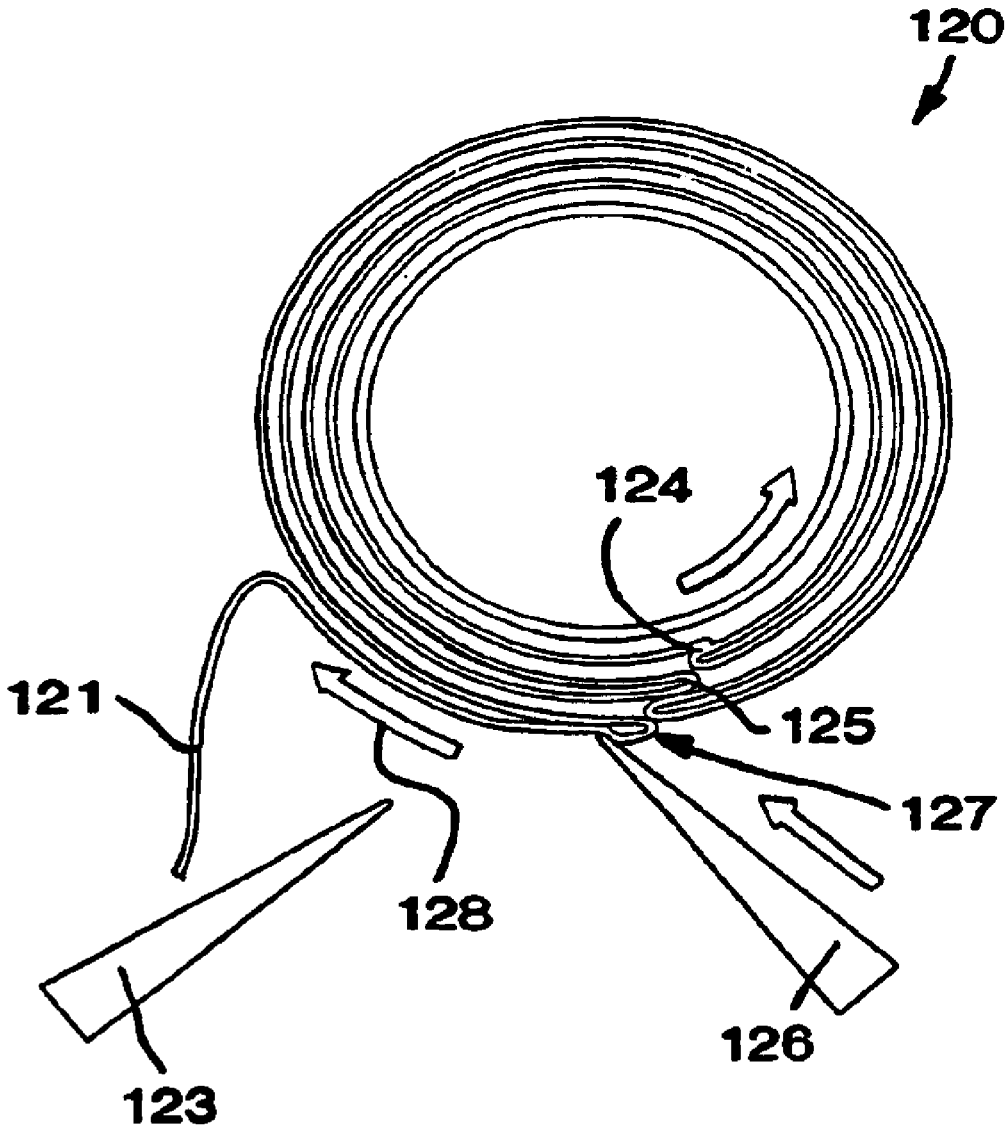
FIG. 8 is another schematic showing how the overlap point may move about the periphery of the web as the web is wound.

In FIG. 7, a first paddle 123 is extended to contact web 121 to hold it while a directional change to counter clockwise direction 122 is made. FIG. 8 shows the rolled web product 120 reversing to proceed again in the clockwise direction 128, with second paddle 126 extended to hold third tail 127 in position to prevent undesirable unraveling as the roll builds.

Figure 9:
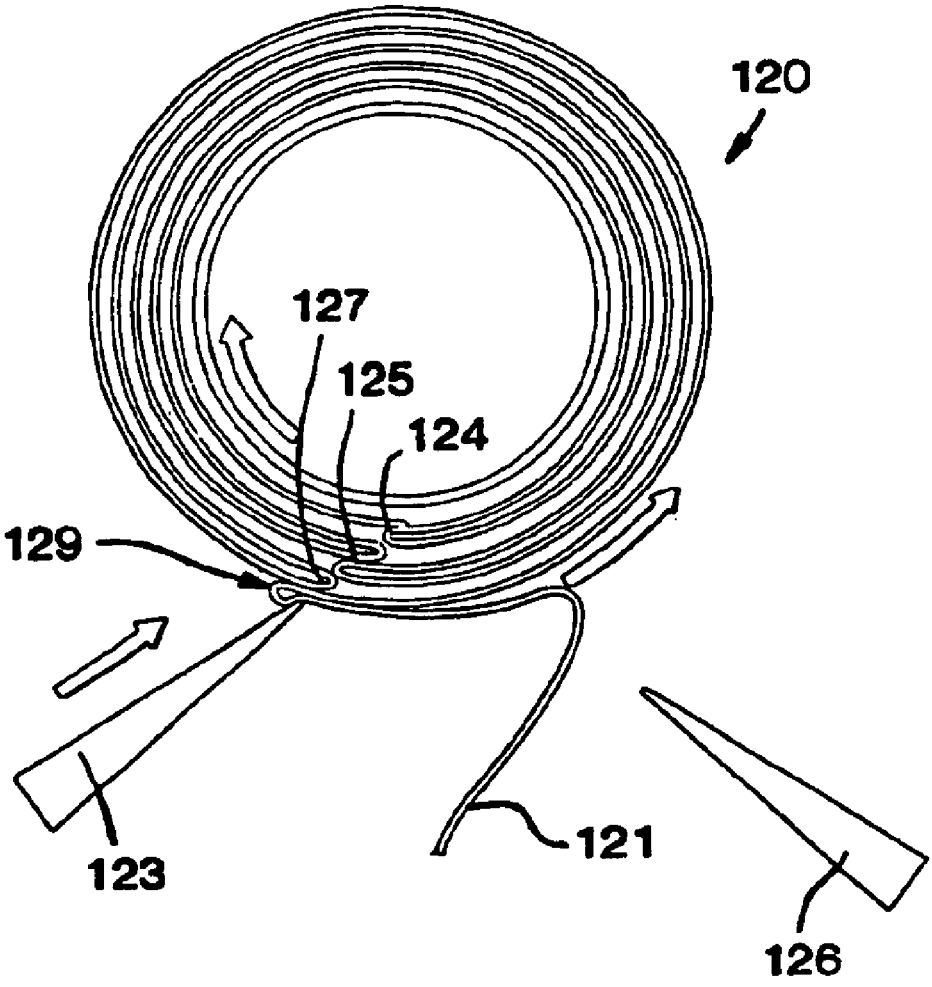
FIG. 9 shows a later point in the winding, when the web winding direction has been reversed.

FIG. 9 shows first paddle 123 once more extended to hold fourth tail 129, as the overlapping and winding process continues.

Figure 10:
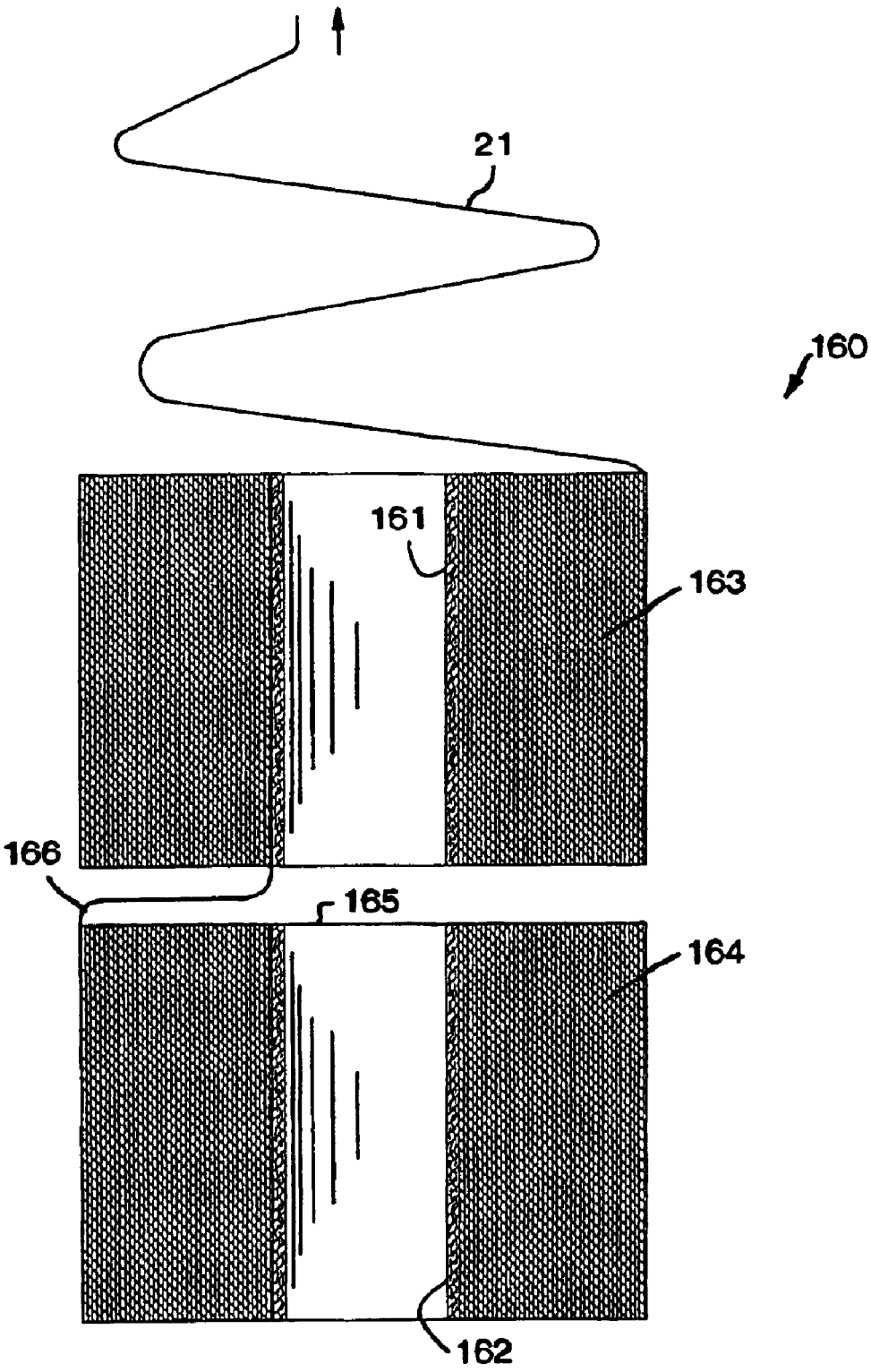
FIG. 10 shows a cross-section of a multiple "stacked" roll assembly that can be manufactured in the practice of the invention.

An example of a stacked roll assembly 160 that can be produced according to the method of the invention as previously described is shown in FIG. 10. In FIG. 10, a stacked roll assembly 160 is shown having a first pancake roll 163 and a second pancake roll 164 stacked vertically. In general, there is no limit to the number of such pancake rolls 163–64 that can be stacked in forming a stacked roll assembly 160. FIG. 5 shows one example in which two stacked pancake rolls 163–64 are provided, but a stacked roll assembly 160 could have as many as four, five, six or more pancake rolls stacked together. The stacked roll assembly 160 could include optional cores 161–62, or in other applications it may be possible to construct pancake roll 163 and pancake 164 without cores 61–62, using a removable mandrel (not shown) or an air cylinder (not shown).

The stacked roll assembly 160 is shown in FIG. 10 in position to be unwound and deployed in the manufacture of products. In FIG. 10, the web 21 is pulled upwards and released from the first pancake roll 163. Once the first pancake roll 163 is exhausted, the process continues with the tail end 165 of the web 21 being connected to the lead end 166 of second pancake roll 164. Deployment of the stacked roll assembly 160 therefore may, in some manufacturing applications, without the necessity of stopping a manufacturing operation to insert a new roll.

In some applications, it is possible to provide a shaft upon which the web 21 is wound (shaft not shown). The web 21 also could be driven through a series of friction drive rollers (not shown in FIG. 10). The web 21 could be attached to such a shaft and wound in a clockwise direction between about 1 and about 3 revolutions, then the process could be halted and a nominal amount of adhesive could be applied to the outside of the web 21. Then, the process could continue in a counter clockwise direction until a nominal amount of web 21 passes through the adhesive application point (not shown in FIG. 10). Then, the direction can be reversed again with the web 21 moving again in the clockwise direction. In this way, the infeed material web 21 could be allowed to move upward, thereby changing the angle of web 21 orientation in reference to the building roll.

It is understood by one of ordinary skill in the art that the present discussion is a description of exemplary embodiments only, and is not intended as limiting the broader aspects of the present invention, which broader aspects are embodied in the exemplary constructions. The invention is shown by example in the appended claims.

What is claimed is:

1. A rolled web product, comprising:

(a) a core having an outer surface, (b) a web wrapped around the core, the web having a first end and a second end and formed from a single sheet being a continuous endless component between the first end and the second end, the first end of the web being positioned adjacent the outer surface of the core, and the second end of the web being positioned on the outer circumferential surface of the roll.

(c) wherein the web is wound upon the outer surface of the core in a manner whereby the web is wound in a first direction, and also in a second and opposite direction, in alternating sequence a plurality of times, from the first end of the web to the second end of the web, wherein the web is wound upon the core so as to have the same axial position with respect to the axis of the core along the length of the web from the first end of the web to the second end of the web.

2. The rolled web product of claim 1 in which the web is wound in a first direction upon the core between about 1 and about 3 revolutions.

3. The rolled web product of claim 1 in which the web is wound in a first direction upon the core between about 370 and about 720 degrees.

4. The rolled web product of claim 1 in which the web is wound upon the core in a pattern resulting from oscillating revolutions about the core, in which a tail is formed upon the web at a plurality of points corresponding to directional changes, further wherein each successive tail overlaps and secures a previous tail.

5. The rolled web product of claim 4, in which the location of the overlap formed by the tail upon the outer circumferential surface of the roll is changed at least once during winding of the roll.

6. The rolled web product of claim 5 in which the amount of roll movement from one directional change to the next directional change comprises an oscillating period, further wherein the location of the tail overlap is different for each oscillating period of the roll.

7. The rolled web product of claim 1 in which the product is selected from the group of products comprising: a fibrous web, a non-fibrous web, a nonwoven web, a film, a plastic film, a non-plastic film, a foam, tape, cording, and textiles.

8. A rolled product formed upon a collapsible airshaft, in which the collapsible airshaft forms a cylindrical-shaped center space within the rolled product, the rolled product comprising a web wrapped in a circular pattern, the web having a first end and a second end and formed from a single sheet being a continuous endless component between the first end and the said second end, the first end of the web being positioned adjacent the center space, and the second end of the web being positioned upon the outer circumferential surface of the roll, wherein the web is wound in a manner whereby the web is wound in both a first direction and a second opposite direction, in alternating sequence, a plurality of times, wherein the web is configured so as to have the same axial position with respect to the axis of the center space along the length of the web from the first end of the web to the second end of the web.

9. The rolled product of claim 8 in which the web is wound in the first direction upon the core between about 1 and about 3 revolutions.

10. The rolled product of claim 8 in which the web is wound wrapped in a first direction between about 370 and about 720 degrees.

11. The rolled product of claim 8 in which the web is wound in a pattern resulting from oscillating revolutions about the center space, in which a tail is formed upon the web at a plurality of points corresponding to directional changes, further wherein each successive tail overlaps and secures a previous tail.

12. The rolled product of claim 11, in which the location of the overlap formed by the tail upon the outer circumferential surface of the roll is changed at least once during winding of the roll.

13. The rolled product of claim 12 in which the amount of roll movement from one directional change to the next directional change comprises an oscillating period, further wherein the location of the tail overlap upon the periphery of the roll is different for each oscillating period of the roll.

14. A stacked roll assembly formed by combining the rolled product of claim 1, defined as the first roll, with a second rolled product.

15. The stacked roll assembly of claim 14 in which:

(a) the first roll has a first end adjacent the first core, and a second end adjacent the outer circumferential surface of the first roll, (b) the second roll has a first end adjacent the second core, and a second end adjacent the outer circumferential surface of the second roll, (c) further wherein the first end of the first roll is mated with the second end of the second roll, such that when the first roll is exhausted, the web is adapted to continue to feed from the second roll.

16. A rolled web product made by the process of winding a web about a central axis to form a roll, comprising:

(a) providing a rotating mandrel, the rotating mandrel being oriented along a central axis, (b) providing a feeding mechanism, the feeding mechanism comprising at least one roller for holding in a feed position a running web formed from a single sheet being a continuous endless component between a first and a second end of the web, the web to be wound upon the mandrel into a roll, (c) providing a retainer assembly, the retainer assembly being mounted around the roll upon the rotating mandrel, (d) oscillating the rotating mandrel between a clockwise and a counterclockwise rotational direction, while winding the web upon the mandrel, wherein the web is wound on the mandrel so as to have the same axial position with respect to the axis of the mandrel along the length of the web from the first end of the web to the second end of the web; and (e) supporting with the retainer assembly the outer portion of the roll during winding of the web upon the mandrel in forming a roll, the retainer assembly having at least one circumferential support stay for engagement of the web on the outer surface of the roll as the roll builds.

17. The rolled web product of claim 16 in which the web is wound in a first direction upon the core between about 1 and about 3 revolutions.

18. The rolled web product of claim 16 in which the web is wound in a first direction upon the core between about 370 and about 720 degrees.

19. The rolled web product of claim 16 in which the web is wound upon the core in a pattern resulting from oscillating revolutions about the core, in which a tail is formed upon the web at a plurality of points corresponding to directional changes, further wherein each successive tail overlaps and secures a previous tail.

20. The rolled web product of claim 19, in which the location of the overlap formed by the tail upon the outer circumferential surface of the roll is changed at least once during winding of the roll.

21. The rolled web product of claim 20 in which the amount of roll movement from one directional change to the next directional change comprises an oscillating period, further wherein the location of the tail overlap is different for each oscillating period of the roll.

22. The rolled web product of claim 16 in which the product is selected from the group of products comprising: a fibrous web, a non-fibrous web, a nonwoven web, a film, a plastic film, a non-plastic film, a foam, tape, cording, and textiles.

* * * * *